US011174098B2

(12) United States Patent
Garfinkel

(10) Patent No.: US 11,174,098 B2
(45) Date of Patent: Nov. 16, 2021

(54) LOGISTICS CONTAINER FOR FRAC SAND AND FRAC LIQUID

(71) Applicant: Frederick A Garfinkel, Johnstown, PA (US)

(72) Inventor: Frederick A Garfinkel, Johnstown, PA (US)

( * ) Notice: Subject to any disclaimer, the term of this patent is extended or adjusted under 35 U.S.C. 154(b) by 0 days.

(21) Appl. No.: 17/230,369

(22) Filed: Apr. 14, 2021

(65) Prior Publication Data

US 2021/0229900 A1 Jul. 29, 2021

(51) Int. Cl.

| | |
|---|---|
| ***B65D 88/30*** | (2006.01) |
| ***B65D 90/00*** | (2006.01) |
| ***B65D 83/06*** | (2006.01) |
| ***B65D 90/58*** | (2006.01) |
| ***B65D 90/20*** | (2006.01) |

(52) U.S. Cl.

CPC ..... *B65D 88/30* (2013.01); *B65D 83/06* (2013.01); *B65D 90/0033* (2013.01); *B65D 90/20* (2013.01); *B65D 90/587* (2013.01)

(58) Field of Classification Search

CPC ..... B65D 88/30; B65D 88/54; B65D 83/06; B65D 90/0033; B65D 90/20; B65D 90/587; B65D 90/0006; B65D 90/0013; B65D 90/0026; B65G 65/30

See application file for complete search history.

(56) References Cited

U.S. PATENT DOCUMENTS

| | | | | |
|---|---|---|---|---|
| 4,662,669 | A * | 5/1987 | Erickson | B01J 8/0015 206/596 |
| 10,793,349 | B2 * | 10/2020 | D'Agostino | B65B 1/04 |
| 2009/0097957 | A1 * | 4/2009 | Cramer | B65G 7/04 414/801 |
| 2015/0086307 | A1 * | 3/2015 | Stefan | B65G 65/30 414/304 |
| 2018/0257857 | A1 * | 9/2018 | Fisher | B65D 88/30 |
| 2019/0002196 | A1 * | 1/2019 | Lucas | B65D 90/20 |
| 2019/0263578 | A1 * | 8/2019 | Beydoun | B01F 7/00975 |

* cited by examiner

*Primary Examiner* — Glenn F Myers

(74) *Attorney, Agent, or Firm* — Barry Choobin; Patent 360

(57) ABSTRACT

A logistics apparatus for transporting frac sand, frac liquid, and/or drill cuttings between a terminal and a well pad. The apparatus includes a container having a top and bottom. The top having one or more inlet port for receiving frac sand and a liquid outlet. The inlet orts can be secured by watertight covers. The bottom of the container is configured as a hopper having an opening secured by a railcar gate. The apparatus, in position having the railcar gate at bottom, can be used to store and transport frac sand. The apparatus can be inverted for transporting the frac liquid.

7 Claims, 4 Drawing Sheets

LOGISTICS CONTAINER FOR FRAC SAND AND FRAC LIQUID

FIELD OF INVENTION

The present invention relates to a container for transporting frac sand, frac liquid, and/or drill cuttings, more particularly, the present invention relates to a container that can be inverted for selectively storing frac sand or frac liquid.

BACKGROUND

With hydraulic fracturing becoming a standard in oil and gas production, the demand for frac sand has climbed exponentially in the last decade. Moreover, an increase in production to cope with the increasing oil prices is also driving the demand for frac sand. The supply of frac sand from the source to well pad to meet the increasing demand poses many challenges in the logistic industry. Besides safety, profitability is also the main concern.

The transport vehicle supplying frac sand from the terminal to the well pad returns empty. The empty backhaul is not economically viable.

Thus, considering the increasing demand for frac sand and shrinking profits, a desire is there for an apparatus and method that can help to meet the demand and also increase profits in the transportation of the frac sand.

Hereinafter the term "terminal" connotes a point of departure of the transport vehicle and it can be a quarry or other sources of frac sand.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus and method for transportation of frac sand.

It is another object of the present invention that the apparatus can be used to backhaul frac liquids and/or drill cuttings.

It is still another object of the present invention that the apparatus provides for better returns in the transportation of frac sand.

It is still another object of the present invention that the apparatus provides for the safe transportation of frac sand.

In one aspect disclosed is a logistics apparatus for transporting frac sand, frac liquid, and/or drill cuttings between a terminal and a well pad. The apparatus includes a container having a top wall, a bottom wall, a left wall, a right wall, a front wall, and a rear wall defining the volume of the container. The top is having two inlet ports secured by two watertight covers and one liquid outlet. The bottom is configured as a hopper, the opening of which is secured by 24 inches railcar gate.

The container is secured in a cage-like structure having a top frame, a bottom frame, and walls extending between the top frame and the bottom frame. Both the top frame and the bottom frame having forklift pockets. Also, iso corners can be provided in the top and bottom frames.

In one aspect, the container in the first position in which the railcar gate is at the bottom can be used to store and transport frac sand. The container can be inverted to a second position in which the railcar gate is at the top, can be used for storing and transporting frac liquid and/or drill cuttings.

These and other objects and advantages of the embodiments herein and the summary will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
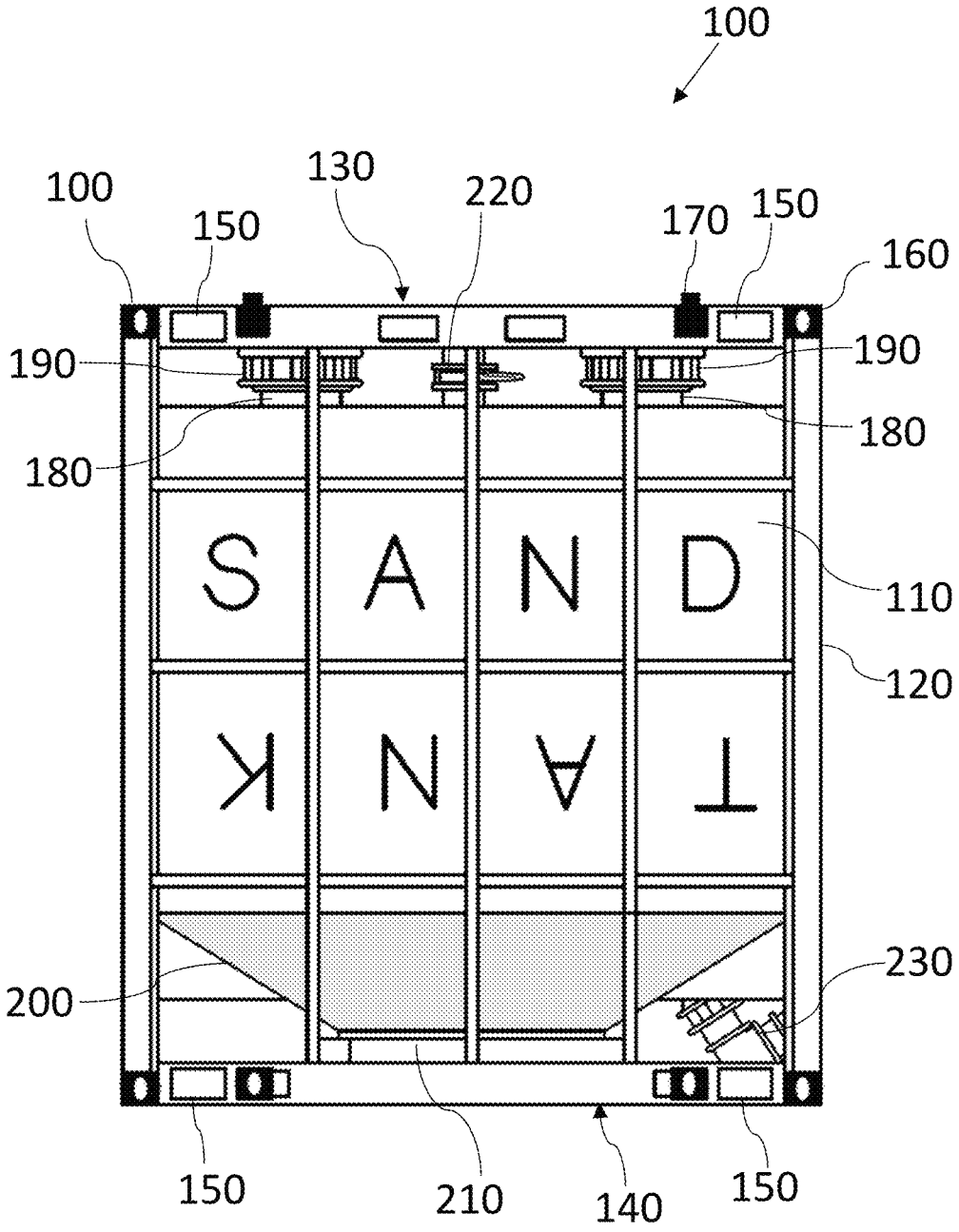
FIG. 1 is a front view of the apparatus showing the two watertight covers, a liquid outlet, and a railcar gate, according to an example embodiment of the present invention.
Figure 2:
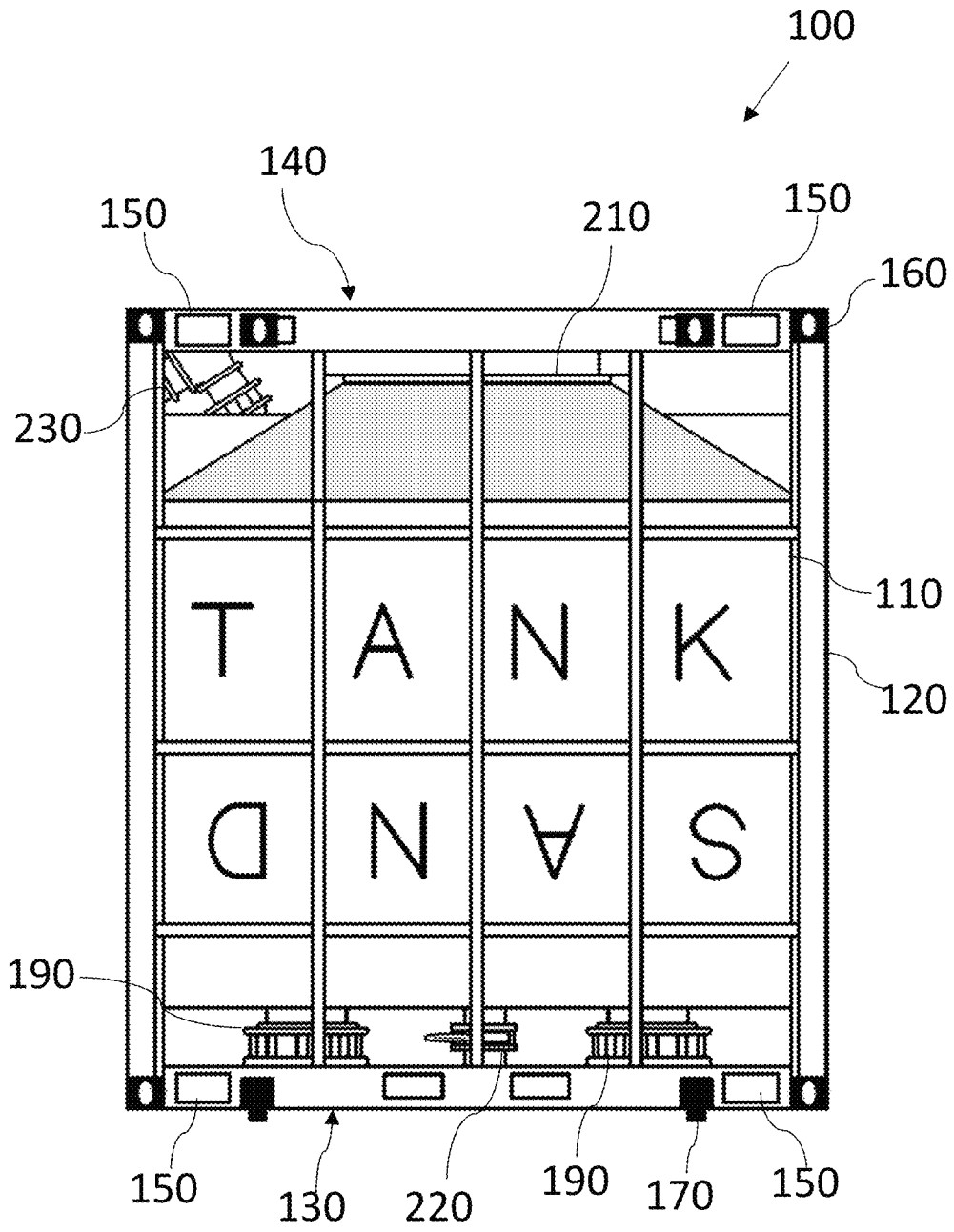
FIG. 2 is a front view of the apparatus shown in FIG. 1 which is inverted for transportation of the frac liquids, according to an example embodiment of the present invention.

Referring to FIG. 1, which shows a front side of the apparatus that can be used to store and transport the frac sand, frac liquid, and/or drill cuttings to a well pad. The apparatus 100 includes a container 110 of a cuboidal shape. The container can be enclosed in a cage 120 for protection. The cage can be rigid and made of a durable material that can withstand the weight of the filled container and shocks during transportation. Cage 120 having a top frame 130 and a bottom frame 140, and four walls sandwiched between the top frame and the bottom frame. The four walls of the frame can be made of cross-lats that provide support to the container and do not significantly increase its weight. Both the top frame 130 and the bottom frame 140 can have forklift pockets, such as the apparatus can be lifted and transported by a forklift crane. FIG. 1 shows the top frame 130 having two spaced-apart fork-lift pockets 150 and the bottom frame 140 having the two forklift pockets 150. The presence of the forklift pockets in both the upper member and the lower member allows the lifting of the apparatus by the forklift crane in both the normal stare and an inverted state. The apparatus can also be inverted by the forklift crane or any similar machine. FIG. 2 shows apparatus 100 in the inverted state. In the first state, as shown in FIG. 1, apparatus 100 can be used to store and transport frac sand, while in the inverted position, as shown in FIG. 2, the apparatus can be used to transport the frac liquid and/or drill cuttings. Frame 120 can also include iso-corners 160, such as twelve iso-corners. The top frame 130 can also include stacking pins 170, such as four stacking pins.

Figure 3:
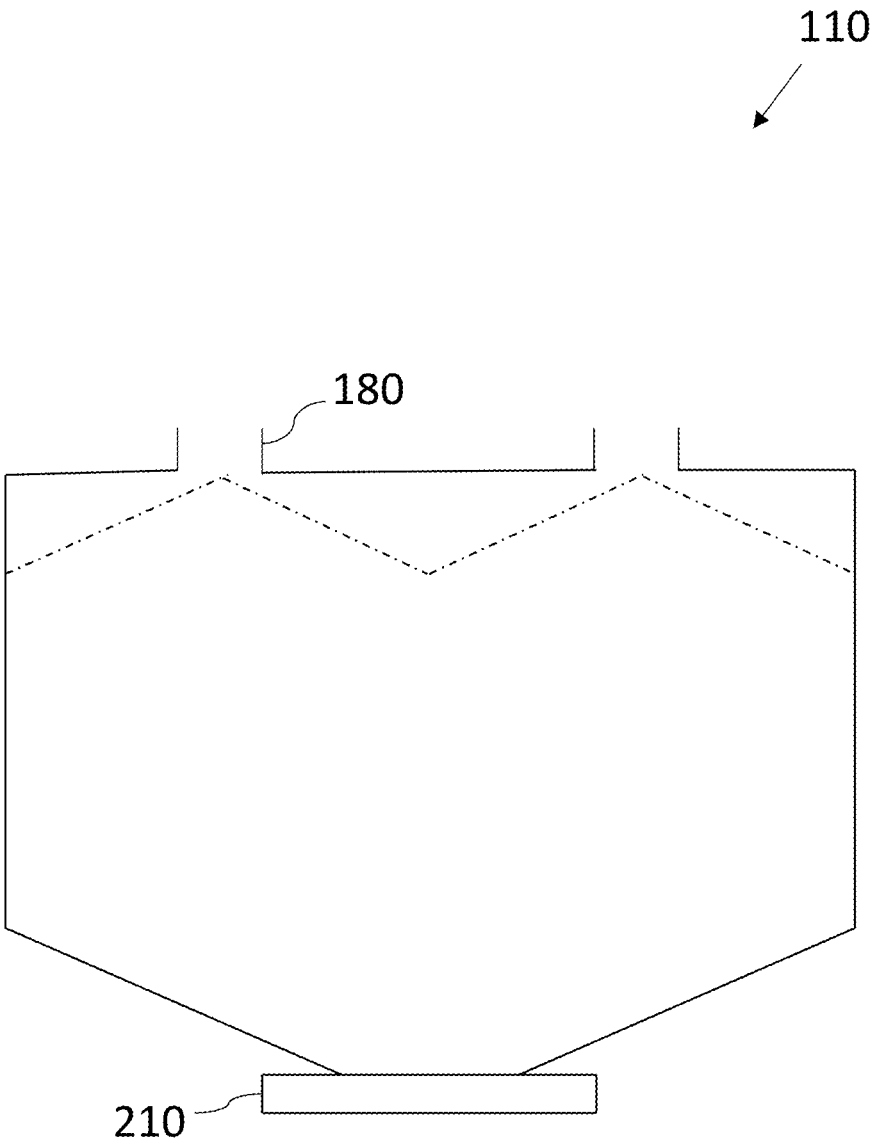
FIG. 3 is a front view of the container of the apparatus, according to an example embodiment of the present invention.
Figure 4:
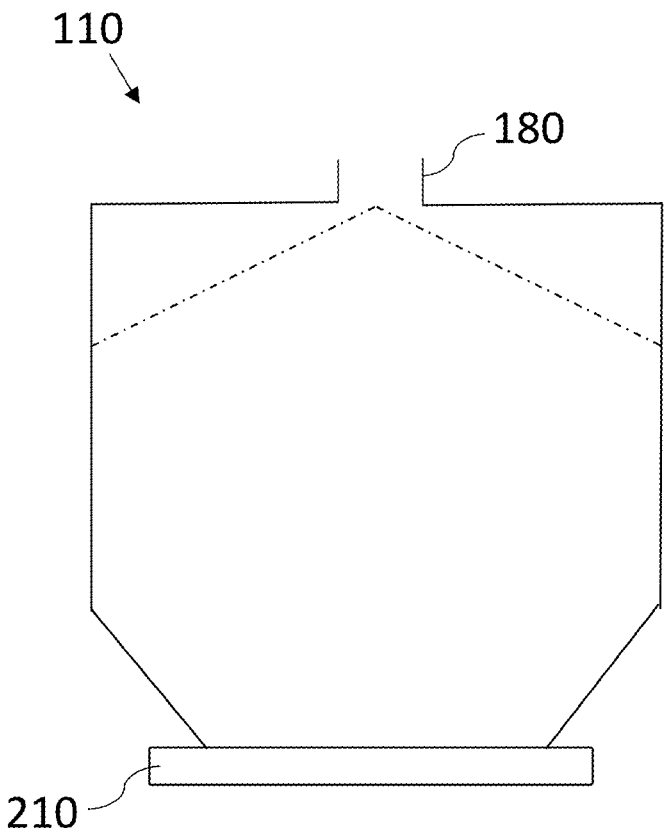
FIG. 4 is a side view of the container, according to an example embodiment of the present invention.

Inside the cage can be seen the container 110 also of a cuboidal shape. FIG. 3 shows an outline view of the front side of container 110 having four sidewalls, a top wall, and a bottom wall defining an inner volume of the container. The top wall can have two inlet ports 180 which can be secured by watertight covers 190. Through these two inlet ports 180 can be poured frac sand into container 110. The bottom of the container can be configured in the shape of a hopper 200. The hopper can have an opening through which the frac sand contained in the container can be dispensed. The opening of the hopper 200 can be secured by a railcar gate 210, the functioning of the railcar gate is known to a skilled person. The sand stored in the container can flow under gravity through the opening of the hopper. The top of the container can also have a liquid outlet 220 for frac liquid. Also, the container can have an air intake valve 230 shown in FIGS. 1 and 2.

To transport frac sand from the terminal to the well pad, the apparatus 100 can be loaded on a transport vehicle. Thereafter, frac sand can be filled in the container through the inlet ports 180 in the top wall of the container. It is obvious that the railcar gate is closed while filling and transporting the frac sand. Once filled the water-tight covers 190 can be secured to the inlet apertures 180, and the apparatus containing the frac sand can be transported to the well pad. At the well pad the container can be emptied by opening the railcar gate 210. The empty apparatus can be inverted, as shown in FIG. 2, and mounted on the transport vehicle in the inverted position. Frac liquids or drill cuttings can then be filled into the container for transport to a destined site which can be the terminal or recycling site.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for transporting frac sand to a well pad, the method comprising the steps of:

providing an apparatus, the apparatus comprises:

a container having a top, a bottom, and sidewalls defining an inner volume of the container, the top having one or more inlet ports configured for receiving frac sand, the one or more inlet ports secured by watertight covers, and the bottom configured as a hopper, the hopper having an opening, the opening of the hopper secured by a watertight railcar gate, emptying the container holding the frac sand by opening the watertight railcar gate;

inverting the apparatus; and filling frac liquid into the container.

2. The method according to claim 1, wherein the container further comprises a liquid outlet configured in the top, the liquid outlet secured by a valve that can be switched between an open state and a closed state.

3. The method according to claim 1, wherein the apparatus further comprises a cage enclosing the container, the cage having a top frame and a bottom frame, the top frame having two spaced apart forklift pockets, the bottom frame having two spaced apart forklift pockets, the bottom frame is adjacent the bottom of the container.

4. An apparatus for selectively transporting frac sand or frac liquid, the apparatus comprises:

a container having a top, a bottom, and sidewalls defining an inner volume of the container;

the top having one or more inlet ports configured for receiving frac sand, the one or more inlet ports secured by watertight covers;

the top further having a liquid outlet secured by a valve, the valve configured to be switched between an open position and a closed position; and the bottom configured as a hopper, the hopper having an opening, the opening of the hopper secured by a watertight railcar gate, wherein the container is configured to switch between a first position and an inverted second position, wherein the container in the first position configured to contain the frac sand and the container in the inverted second position configured to contain the frac liquid, wherein the liquid outlet is for the frac liquid.

5. The apparatus according to claim 4, wherein the apparatus further comprises a cage, the cage encasing the container, the cage having a top frame and a bottom frame, the top frame having two forklift pockets and the bottom frame have two forklift pockets.

6. The apparatus according to claim 5, wherein the top frame of the apparatus further comprises four stacking pins.

7. The apparatus according to claim 5, wherein the apparatus configured to be alternatively mounted to a transport vehicle in the first position and the second inverted position.

* * * * *